US006557708B2

(12) United States Patent
Polacco

(10) Patent No.: US 6,557,708 B2
(45) Date of Patent: May 6, 2003

(54) CARDBOARD PALLET-TYPE CONTAINER/EXHIBITOR

(76) Inventor: Giorgio Polacco, Via Arimondi, 2/2-35100, Padova (IT)

( * ) Notice: Subject to any disclaimer, the term of this patent is extended or adjusted under 35 U.S.C. 154(b) by 0 days.

(21) Appl. No.: 09/764,081

(22) Filed: Jan. 19, 2001

(65) Prior Publication Data

US 2001/0002652 A1 Jun. 7, 2001

Related U.S. Application Data

(63) Continuation of application No. PCT/IB99/01372, filed on Aug. 2, 1999.

(30) Foreign Application Priority Data

Aug. 5, 1998 (IT) ..... PD98A0192

(51) Int. Cl.[7] ..... B65D 25/54

(52) U.S. Cl. ..... 206/774; 206/599; 206/736; 229/210; 229/164

(58) Field of Search ..... 206/386, 599, 206/600, 736, 774; 108/56.3, 57.12; 229/164, 207, 210, 220, 235

(56) References Cited

U.S. PATENT DOCUMENTS 2,355,206 A * 8/1944 Davidson ..... 229/34
2,528,900 A * 11/1950 Meller ..... 229/35
3,664,494 A * 5/1972 Mergens ..... 206/44
4,445,614 A * 5/1984 Mitsumori et al. ..... 206/599
4,697,699 A * 10/1987 Schneider ..... 206/44.11
4,938,363 A * 7/1990 Amendola ..... 206/606
5,406,892 A * 4/1995 Kilpatrick et al. ..... 108/51.3

FOREIGN PATENT DOCUMENTS

| | | |
|---|---|---|
| FR | A-2 620 682 | 3/1989 |
| GB | A-2 027 413 | 2/1980 |
| GB | 2305163 A * | 4/1997 |
| WO | 0619238 A1 * | 10/1994 |
| WO | A-97 18133 | 5/1997 |

* cited by examiner

*Primary Examiner*—Mickey Yu
*Assistant Examiner*—Troy Arnold
(74) *Attorney, Agent, or Firm*—Guido Modiano; Albert Josif; Daniel O'Byrne

(57) ABSTRACT

The present invention relates to a cardboard pallet-like container which also acts as an exhibitor.

The container is obtained from a single sheet of die-cut and folded cardboard by means of which the entire structure is obtained.

The container is a parallelepiped which is cut, on each lateral face, along a diagonal so as to obtain a base semi-container provided with legs and a top semi-container which can be fitted over the base semi-container.

19 Claims, 4 Drawing Sheets

CARDBOARD PALLET-TYPE CONTAINER/EXHIBITOR

CROSS-REFERENCE TO RELATED APPLICATIONS

This application is a continuation of application number PCT/IB99/01372 filed on Aug. 2, 1999.

BACKGROUND OF THE INVENTION

The present invention relates to a cardboard pallet-type container/exhibitor.

In recent times, a type of large container made of a single material is becoming increasingly widespread in packaging technology due to ecological reasons and package-recycling laws.

This is in fact the only way to reduce the relative amount of material assigned to packaging and at the same time allow complete recycling of the package without having to separate parts made of different materials.

A second strongly felt requirement, particularly in the field of packaging meant for products to be distributed in shops and supermarkets, is that the container must be able to also act as an exhibitor, so that the customer can directly take the packages contained therein in the required amount.

SUMMARY OF THE INVENTION

The aim of the present invention is to provide a container which can be manufactured by using a single material and can be obtained with a very simple operation.

An important object is to provide a container which can be placed directly in the point of sale so that it constitutes the exhibitor for the products contained therein.

Another object of the present invention is to provide a large container which can be easily filled in an orderly fashion even without necessarily resorting to automatic loading systems.

A further important object of the present invention is to provide a container which can be easily and completely filled with products intended for sale and then emptied manually or through automatic equipment and allows easier access.

Another object of the present invention is to provide a container/exhibitor at low-cost.

A container/exhibitor made in folded cardboard is known from the document GB-A-2 027 413.

The aim and the objects of the present invention and others which will become apparent hereinafter are achieved instead by a container/exhibitor having the features of claim 1.

BRIEF DESCRIPTION OF THE DRAWINGS

Further characteristics and advantages of the present invention will become better apparent from the description of a preferred embodiment thereof, illustrated only by way of non-limitative example in the accompanying drawings, wherein.

DESCRIPTION OF THE PREFERRED EMBODIMENTS

Figure 1:
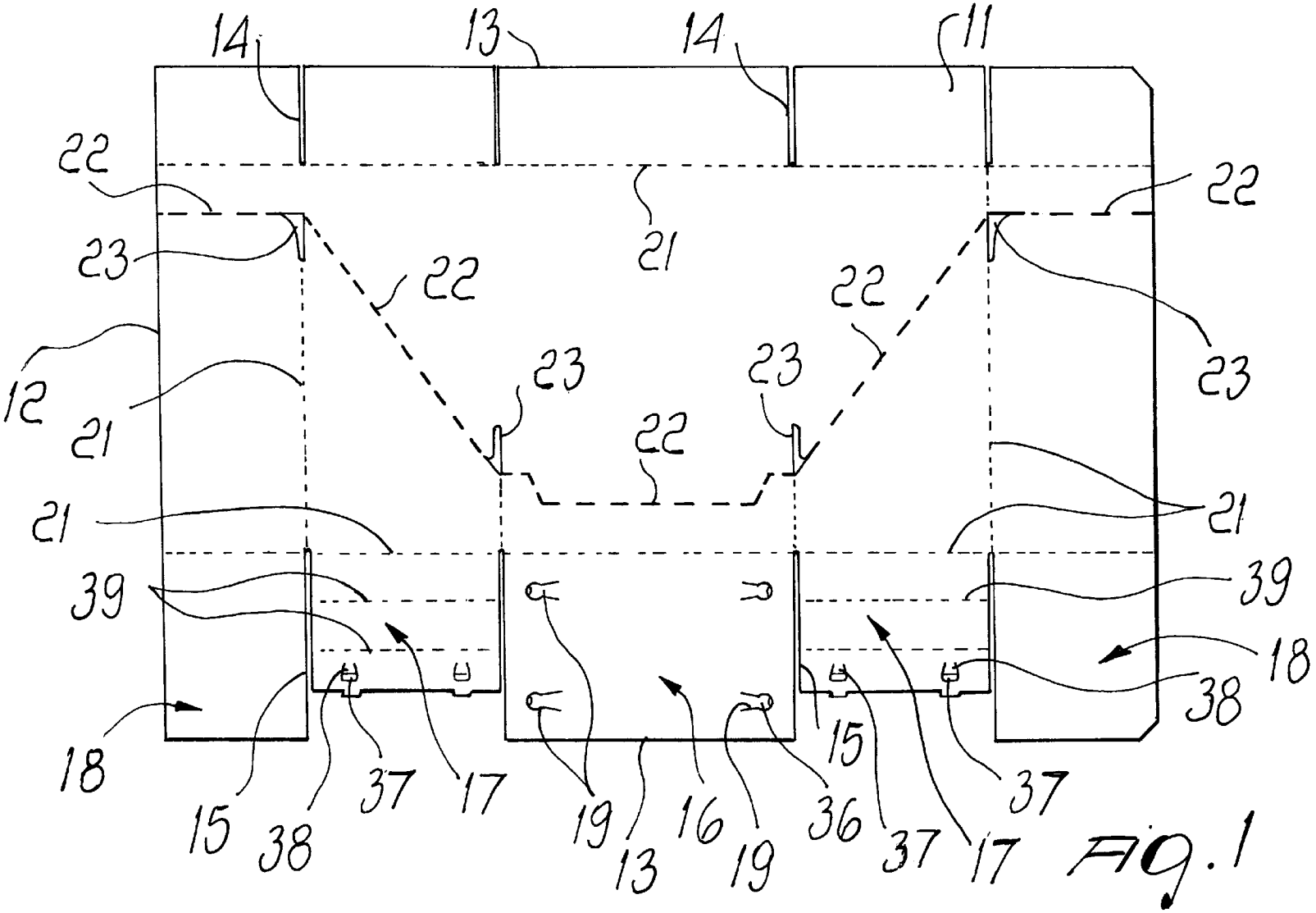
FIG. 1 is a top view of a cardboard sheet from which a container/exhibitor according to the present invention is to be obtained.

With reference to the above figures, a container/exhibitor according to the present invention is generally designated by the reference numeral 10 and is obtained starting from a sheet 11 made of corrugated cardboard.

Said sheet 11 is substantially rectangular and has first mutually opposite sides 12 and second longer mutually opposite sides 13.

Proximate to one of said second sides 13, which forms the upper part of the container/exhibitor 10 as will become apparent hereinafter, first parallel transverse slots 14 are provided at regular intervals.

At the other second side 13, which forms the lower part of the container/exhibitor 10, second slots 15 are provided which are also parallel and define a central portion 16 and first and second portions 17 and 18 to the sides of said central portion.

Tabs 19 are formed by cutting in said central portion 16, and each tab has a free end 36 which is wider than the rest.

Shaped holes 37, associated with a retention tab 38, are formed in said first portions 17, each of which is arranged to one side of the central portion 16.

Said central portion 16 constitutes the bottom 20 of the container/exhibitor, since it is adapted to be conveniently assembled, by means of suitable interlocks between the edges formed by said second slots 15, to the second portions 18.

First pressed lines 21 which constitute guiding lines for folding are formed in said cardboard sheet 11 along lines which are parallel to said first and second mutually opposite sides 12 and 13.

In particular, said first pressed lines 21 are spaced from the corresponding second sides 13 by a distance which corresponds to the extension of the respective first and second slots 14 and 15.

It is observed that second mutually parallel pressed lines 39 are formed in said first portions 17, as will become apparent hereinafter.

Moreover, through cuts 22 are provided in the sheet 11 and form, as a whole, a discontinuous straight path so as to constitute guides for tearing.

Said through cuts 22 are obtained in the sheet 11 by die-cutting, preferably simultaneously with said first and second slots 14 and 15.

In particular, third transverse slots 23 are formed in the cardboard sheet 11 proximate to the regions where said through cuts 22 change direction, as will become apparent hereinafter.

Starting from the cardboard sheet 11 and performing the appropriate folds according to the corresponding folding guides formed by said first pressed lines 21, and after performing the appropriate interlocks between the edges formed by said first and second slots 14 and 15, an internally hollow parallelepiped is obtained from which said container/exhibitor 10 is obtained by following said tearing guides formed by the through cuts 22.

In particular, it is necessary to produce, on the first portions 17, the folds formed by said second pressed lines 39 so as to give each portion a U-like cross-section whose wings 40 diverge outward.

In this manner, each one of said first portions 17 constitutes a first component for supporting legs, generally designated by the reference numeral 28, of the container/exhibitor 10.

Said container/exhibitor 10 comprises a base semi-container, designated by the reference numeral 24, which is constituted by said flat bottom 20, provided with the legs 28 as better described hereinafter, from which there protrude a low front wall 25, a quite high rear wall 26, and mutually opposite side walls 27 which are delimited in an upward region along the diagonals.

The upper profile of the front wall 25, of the rear wall 26 and of the side walls 27 is formed by the path of said through cuts 22.

In this constructive configuration, each one of said supporting legs 28 is obtained by inserting in the corresponding first U-shaped portion 17 a second component 41 known per se, for example of the type disclosed in EPA No. 96938186.2 of Nov. 12, 1996.

Thereafter, the assembly of the legs 28 is completed by inserting each one of the tabs 19 in the wider part of the corresponding shaped hole 37, in which it is retained by interlocking, due to the weight of the container/exhibitor 10 and of the items contained therein, also in association with the retaining tab 38 which retains the corresponding free end 36.

Said container/exhibitor 10 further comprises a top semi-container 29 whose structure is complementary to the base semi-container 24 and has a top surface 30 from which there extend a front wall 31, whose height substantially corresponds to the height of the rear wall 26 of the base semi-container 24, a rear wall 32 of reduced height, and mutually opposite side walls 33, whose profiles follow the profiles of the corresponding side walls 27 of the base semi-container 24.

Said top semi-container 29 is suitable to be fitted over said base semi-container 24 thanks to the presence of said third transverse slots 23, which allow a suitable widening of the front wall 31 and of the side walls 33 of the top semi-container 29 with respect to the corresponding walls 25 and 27 of the base semi-container 24.

Figure 2:
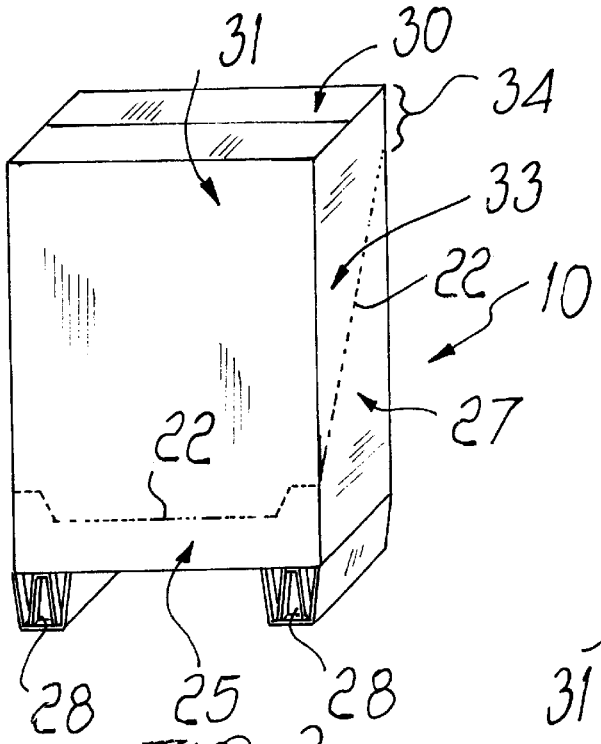
FIG. 2 is a perspective view of the container/exhibitor according to the invention, freshly obtained from the cardboard sheet of FIG. 1.
Figure 3:
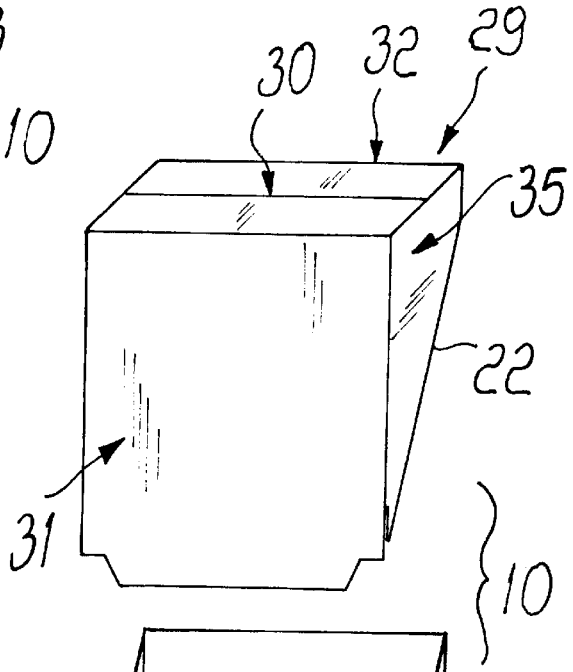
FIG. 3 is a view of the container/exhibitor of FIG. 2, divided along the die-cut lines into a base semi-container and a top semi-container.
Figure 3:
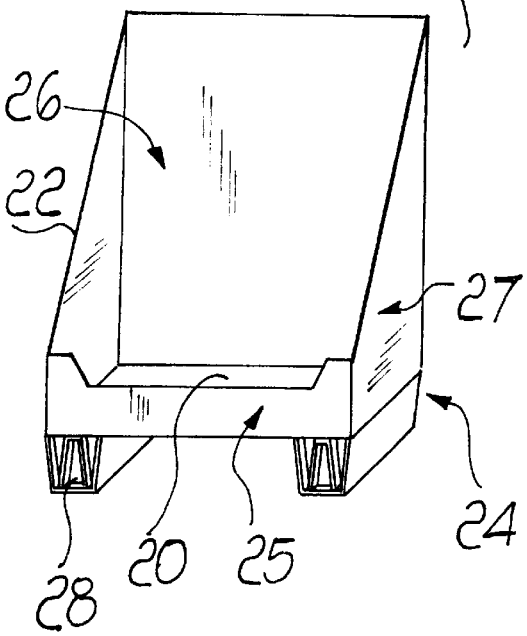
Figure 4:
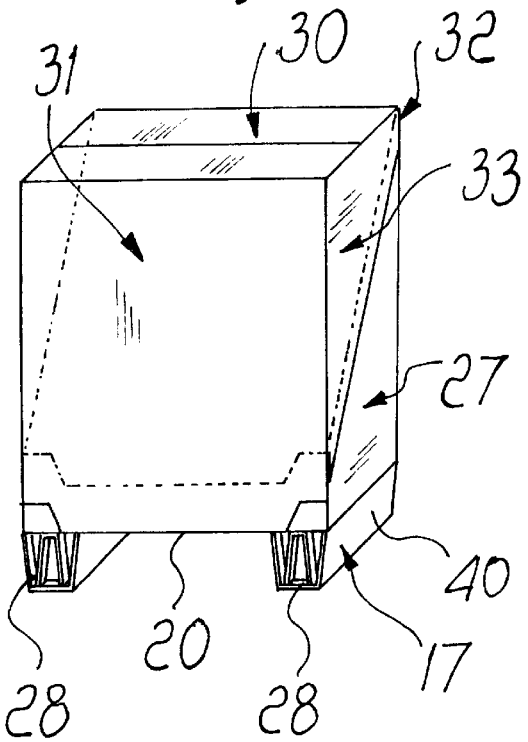
FIG. 4 is a view of the container/exhibitor, reassembled after filling with small products.
Figure 5:
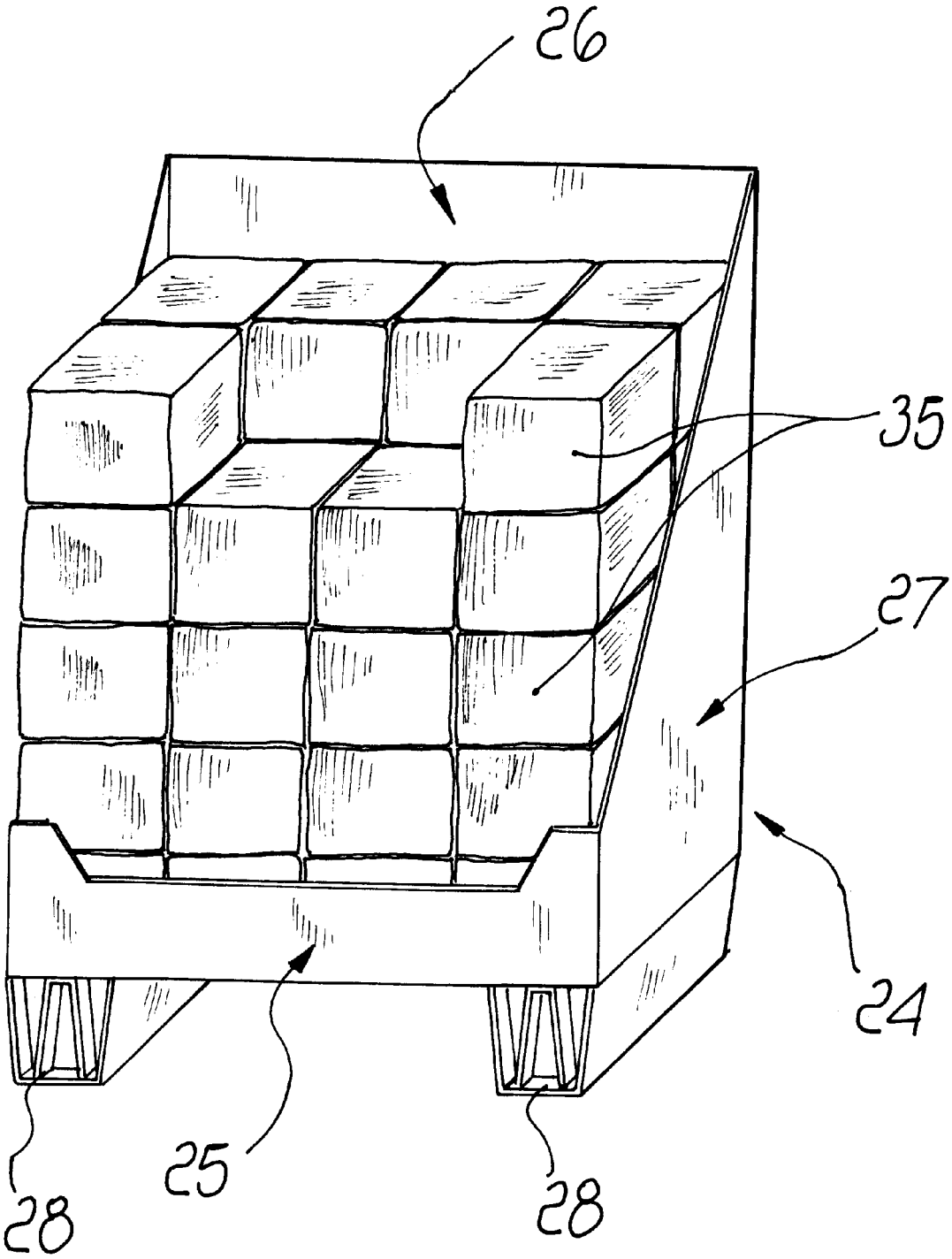
FIG. 5 is a view of the container/exhibitor, open and acting as an exhibitor.
Figure 6:
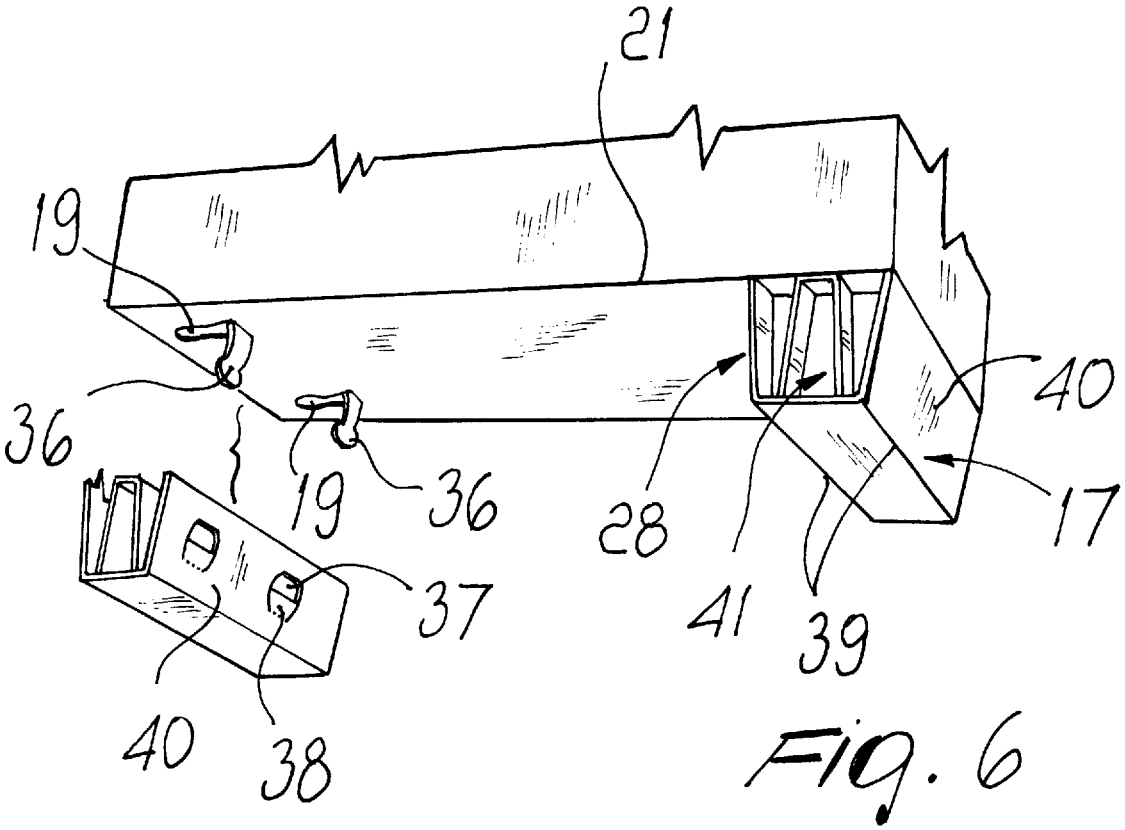
FIG. 6 is a partially exploded perspective view of the lower part of the container/exhibitor of FIG. 5.
Figure 7:
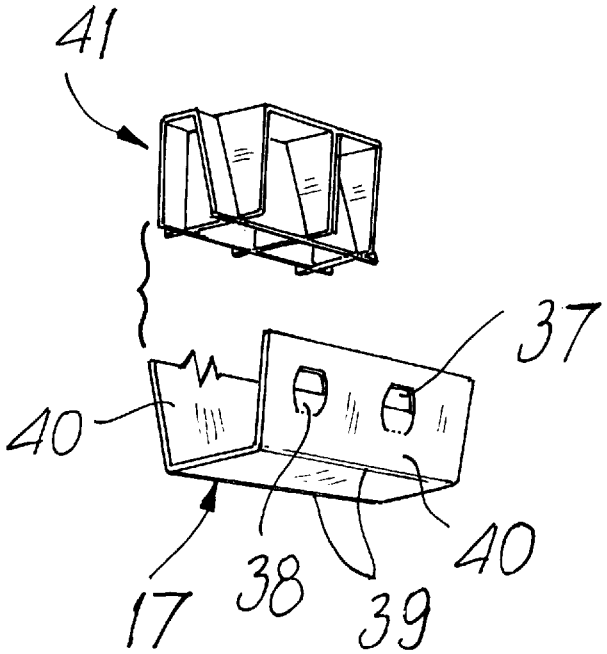
FIG. 7 is an exploded view of a detail of FIG. 6.

The coupling of said top semi-container 29 on the base semi-container 24 is possible by overlapping a portion that corresponds to the distance, schematically designated by the reference numeral 34, which lies in FIG. 2 between the profile of the rear wall 26 of the base semi-container 24, formed by the through cuts 22, and the corresponding first pressed portion 21 that forms the fold between the top surface 30 and the rear wall 32 of the top semi-container 29.

As regards the structure of the container/exhibitor 10, access to its interior is facilitated thanks to the low front wall 25 of the base semi-container 24, so that the insertion of the products, schematically designated by the reference numeral 35, and their subsequent removal can be performed easily.

In practice it has been found that the present invention has achieved its aim and all its objects.

It is in fact interesting to notice that the container/exhibitor 10 obtained with the present invention is made of a single fully recyclable material.

It is also important to note the fact that said container/exhibitor 10 can be arranged directly in the point of sale, since it acts as an exhibitor for the products 35, of the individually-packaged type, contained therein.

Accordingly, a purchaser can easily remove, in the chosen amount, the products that he intends to acquire.

A particular advantage is ensured with the present invention in that a container has been provided which allows easy removal or insertion of items therein or therefrom even in the vicinity of the bottom, since access to its interior is facilitated.

Another considerable advantage is clearly linked to the fact that the described container/exhibitor can be manufactured with machines and equipment which are conventional in the field, at a low cost and by using a single recyclable material, preferably cardboard, by assembling the parts by interlock couplings without using adhesives.

The present invention is susceptible of numerous modifications and variations, all of which are within the scope of the claims.

The materials used, so long as they are compatible with the contingent use, as well as the dimensions, may be any according to requirements.

All the details may also be replaced with other technically equivalent elements.

The disclosures in Italian Patent Application No. PD98A000192 from which this application claims priority are incorporated herein by reference.

I claim:

1. A container/exhibitor constituted by a hollow parallelepiped box made from a single sheet of cardboard, die-cut and folded along folding guides with front, rear, side, top and bottom faces, the sheet being rectangular and including first opposite sides and second opposite sides delimited by respective ones of said folding guides, said first sides being foldable to form the rear face of the body and said second sides being foldable to form the top and, respectively, the bottom face of the body, the container/exhibitor comprising:

tearing guides provided along a contour line defined by a slant section plane which intersects an upper part of the rear face, the side faces and a lower part of the front face of said body;

a base semi-container;

a top semi-container which is coupleable to said base semi-container said top and base semi-containers being formed through division of said body at said tearing guides, said base semi-container having an upper peripheral edge delimiting a low front wall and a high rear wall joined by opposite side walls thereof, and said top semi-container having a complementary lower peripheral edge delimiting corresponding front, rear and side walls thereof;

edge slots, provided at vertical edges of said body so as to intersect said tearing guides and to enable widening of one of said peripheral edges for mutual coupling of said top and base semi-containers by partial overlapping; and supporting legs, provided at the bottom face of said base semi-container, which are formed by folding dedicated portions of said second sides of the sheet along folding guides thereof.

2. The container/exhibitor of claim 1, wherein said folding guides are provided by pressed lines and said tearing guides by cuts, which are pre-formed in said cardboard sheet.

3. The container/exhibitor of claim 2, wherin said edge slots are located, after division of said top and base semi-containers, at vertical edges of the top semi-container to allow the widening of said lower peripheral edge thereof and overlapping of the front and side walls of the top semi-container to the corresponding walls of the base semi-container with partial fitting of the former over the latter.

4. A container/exhibitor for transportation and exhibition of products, comprising:

a hollow, parallelepiped body which has front, rear, top, bottom and side faces;

tearing guides provided at said body along a contour line defined by a slant section plane which intersects an upper part of the rear face, the side faces and a lower part of the front face of said body;

edge slots, provided at vertical edges of said body so as to intersect said tearing guides; and supporting legs, provided at the bottom face of said body; wherein said body and said supporting legs are formed in a single sheet of die-cut cardboard which has dedicated portions thereof folded along folding guides, and wherein said body constitutes, by separation along said tearing guides, a top semi-container and a base semi-container, with said base semi-container having an upper peripheral edge and said top semi-container having a complementary lower peripheral edge, and wherein said top and base semi-containers are coupleable to each other through widening of one of said peripheral edges and partial overlapping, said peripheral edge widening being enabled by said edge slots.

5. The container/exhibitor of claim 4, wherein said folding guides are provided by pressed lines and said tearing guides by through cuts, which are pre-formed in said cardboard sheet.

6. The container/exhibitor of claim 5, wherein said edge slots are located at vertical edges of the top semi-container so that said lower peripheral edge thereof widens and front and side walls of the top semi-container overlap corresponding front and side walls of the base semi-container with partial fitting of the former over the latter.

7. The container/exhibitor of claim 6, wherein said cardboard sheet comprises: a side central portion, arranged at a side region thereof which forms by folding the bottom face of said parallelepiped body; said dedicated portions which are provided at sides of said central portion and have folding guides comprising parallel pressed lines, said dedicated portions being folded along said parallel pressed lines to provide supporting components with a U-shaped cross-section which form said supporting legs; and parallel second slots provided at said side region so as to define said central portion and said dedicated portions.

8. The container/exhibitor of claim 7, wherein said cardboard sheet further comprises: tabs die-cut in said central portion of said sheet, each one of said tabs having a free end which is wider than a remaining part of the tab; shaped holes with associated retention tabs formed in each one of said dedicated portions, each one of said supporting legs being constituted by a corresponding one of said dedicated portions folded and retained in folded configuration by interlocking association of a respective one of said tabs with a respective one of said retention tabs, said retention tabs retaining each a corresponding tab free end inserted in a corresponding one of said shaped holes.

9. The container/exhibitor of claim 8, wherein said supporting legs are constituted by said supporting components having U-shaped cross-section in combination with additional second components inserted therein.

10. The container/exhibitor of claim 8, wherein said single sheet is made of fully recyclable cardboard and is assembled to form said body and supporting legs by interlocking.

11. A container/exhibitor for transportation and exhibition of products, comprising:

a hollow, parallelepiped body which has front, rear, top, bottom and side faces;

tearing guides provided at said body along a contour line defined by a slant section plane which intersects an upper part of the rear face, the side faces and a lower part of the front face of said body;

edge slots, provided at vertical edges of said body so as to intersect said tearing guides; and supporting legs, provided at the bottom face of said body; wherein said body constitutes, by separation along said tearing guides, a base semi-container having an upper peripheral edge delimiting a low front wall and a high rear wall joined by opposite side walls thereof, and a top semi-container having a complementary lower peripheral edge delimiting corresponding front, rear and side walls thereof; and wherein said body and said supporting legs are formed in a single sheet of die-cut cardboard which comprises a side central portion arranged at a side region thereof and which forms by folding the bottom face of said parallelepiped body, first and second dedicated portions which are provided at sides of said central portion and have folding guides comprising parallel pressed lines, said first and second dedicated portions being folded along said parallel pressed lines to provide said supporting legs, and wherein said top and base semi-containers are coupleable to each other through widening of one of said peripheral edges and partial overlapping, said peripheral edge widening being enabled by said edge slots.

12. The container/exhibitor of claim 11, wherein said folding guides are provided by pressed lines and said tearing guides by through cuts, which are pre-formed in said cardboard sheet.

13. The container/exhibitor of claim 12, wherein said edge slots are located at vertical edges of the top semi-container so that said lower peripheral edge thereof widens and front and side walls of the top semi-container overlap corresponding front and side walls of the base semi-container with partial fitting of the former over the latter.

14. The container/exhibitor of claim 13, wherein cardboard sheet is substantially rectangular and further comprises first and second mutually opposite sides which form by folding the top and rear faces of said box, said dedicated portions being folded along said parallel pressed lines to provide supporting components with a U-shaped cross-section which form said supporting legs.

15. The container/exhibitor of claim 14, wherein said cardboard sheet further comprises: tabs die-cut in said side central portion of said sheet, each one of said tabs having a free end which is wider than a remaining part of the tab; shaped holes with associated retention tabs formed in each one of said dedicated portions, each one of said supporting legs being constituted by a corresponding one of said dedicated portions folded and retained in folded configuration by interlocking association of a respective one of said tabs with a respective one of said retention tabs, said retention tabs retaining each a corresponding tab free end inserted in a corresponding one of said shaped holes.

16. The container/exhibitor of claim 15, wherein said supporting legs are constituted by said supporting components having U-shaped cross-section in combination with additional second components inserted therein.

17. The container/exhibitor of claim 15, wherein said single sheet is made of fully recyclable cardboard and is assembled to form said body and supporting legs by interlocking.

18. A container/exhibitor for transporation and exhibition of products, comprising:

a hollow, parallelepiped body which has front, rear, top, bottom and side faces;

tearing guides provided at said body along a contour line defined by a slant section plane which intersects an upper part of the rear face, the side faces and a lower part of the front face of said body;

edge slots, provided at vertical edges of said body so as to intersect said tearing guides; and supporting legs, provided at the bottom face of said body; wherein said body constitutes, by separation along said tearing guides, a base semi-container having an upper peripheral edge delimiting a low front wall and a high rear wall joined by opposite side walls thereof, and a top semi-container having a complementary lower peripheral edge delimiting corresponding front, rear and side walls thereof; and wherein said body and said supporting legs are formed in a single sheet of die-cut cardboard which comprises a side central portion arranged at a side region thereof and which forms by folding the bottom face of said parallelepiped body, first and second dedicated portions which are provided at sides of said central portion and have folding guides comprising parallel pressed lines, said first and second dedicated portions being folded along said parallel pressed lines and secured by interlocking to said central part to form said sorting legs, and wherein said top and base semi-containers are coupleable to each other through widening of one of said peripheral edges and partial overlapping, said peripheral edge widening being enabled by said edge slots.

19. The container/exhibitor of claim 18, wherein said cardboard sheet further comprises: tabs die-cut in said side central portion of said sheet, each one of said tabs having a free end which is wider than a remaining part of the tab; shaped holes with associated retention tabs formed in each one of said dedicated portions, each one of said supporting legs being constituted by a corresponding one of said dedicated portions folded and retained in folded configuration by interlocking association of a respective one of said tabs with a respective one of said retention tabs, said retention tabs retaining each a corresponding tab free end inserted in a corresponding one of said shaped holes.

* * * * *